US007088355B1

(12) United States Patent
Ochi

(10) Patent No.: US 7,088,355 B1
(45) Date of Patent: Aug. 8, 2006

(54) INFORMATION DISPLAY DEVICE

(75) Inventor: Keizou Ochi, Takatsuki (JP)

(73) Assignee: Minolta Co., Ltd., Osaka (JP)

( * ) Notice: Subject to any disclaimer, the term of this patent is extended or adjusted under 35 U.S.C. 154(b) by 845 days.

(21) Appl. No.: 09/645,375

(22) Filed: Aug. 24, 2000

(30) Foreign Application Priority Data

Aug. 31, 1999 (JP) ..... 11-244548

(51) Int. Cl.
*G09G 5/00* (2006.01)

(52) U.S. Cl. ..... 345/211; 345/212

(58) Field of Classification Search ..... 345/87, 345/94, 99, 102, 204, 211, 212, 213
See application file for complete search history.

(56) References Cited

U.S. PATENT DOCUMENTS 4,328,490 A * 5/1982 Usuba et al. ..... 345/618
5,184,117 A * 2/1993 Gauthier ..... 345/102
6,038,515 A * 3/2000 Kikuchi et al. ..... 702/63
6,256,742 B1 * 7/2001 Konaka et al. ..... 713/320
6,476,590 B1 * 11/2002 Chou ..... 323/284

FOREIGN PATENT DOCUMENTS

JP 09-090317 A 4/1997

* cited by examiner

*Primary Examiner*—Kent Chang
(74) *Attorney, Agent, or Firm*—Sidley Austin LLP

(57) ABSTRACT

A display device has a display element which maintains a displayed image without a supply of electrical power and a changing means for changing the displayed image using electrical power. A power supply provides electrical power to the changing means. Detecting means detects a level of voltage supplied by the power supply and a means, for controlling whether the displayed image is changed by the changing means, operates based upon a level of voltage detected by the detecting means.

18 Claims, 5 Drawing Sheets

INFORMATION DISPLAY DEVICE

FIELD OF THE INVENTION

The present invention pertains to an information display device, and more particularly, to an information display device equipped with a display having a memory capability.

BACKGROUND OF THE INVENTION

The conventional art has focused on the use of chiral nematic liquid crystal that exhibits a cholesteric phase as a display medium. Because this type of liquid crystal has a memory capability, power is needed only when image is drawn, and the supply of power may be terminated when the display of an image is being maintained, making it ideal for low energy consumption. It is also capable of color and large-screen display. Therefore, it may be widely used in small to large items, i.e., from portable terminal devices such as electronic books to indoor or outdoor billboards or bulletin boards.

However, because this type of liquid crystal has a memory capability, where it is equipped with a power supply unit that entails an unstable supply of power, such as a dry battery, a battery or a solar battery, if the power supply runs out while an image is being redrawn, or if the supply of power is terminated due to insufficient charging, the image becomes stored in the memory in an incomplete or distorted fashion. While this might not be a significant problem where the user is an individual, it would appear very unsightly on a display used in a public location.

Moreover, where the screen can be reset to a prescribed display condition or a different display can be made to appear once the reset operation is performed, the following problems may occur: the screen present when the reset operation was performed may remain on the screen without display information, or some of the previous display may remain on the supposedly reset screen.

BRIEF SUMMARY OF THE INVENTION

Accordingly, an object of the present invention is to provide an information display device in which the problem of incomplete screen display due to a failure of the power supply is prevented from occurring.

In order to achieve the object described above, the information display device pertaining to the present invention is equipped with a display that requires power when performing image draw and stores the drawn image in memory after the supply of power terminates, a power supply that supplies power for the driving of the display, a detecting means to detect the level of voltage supplied by the power supply, and a control means that prevents the image redraw operation from being performed as to at least a part of the display based on the level of voltage detected by the detecting means.

In the invention having the construction described above, the level of voltage being supplied from the power supply is detected in order to determine whether or not sufficient power remains in the power supply to redraw the image on the display, and if redraw using the remaining power is not possible, image redraw is prohibited. Therefore, the problems of (i) termination of power during image redraw leading to an incomplete or distorted image remaining on the display, or (ii) an old image remaining after reset, may be prevented.

In the present invention, where the detected voltage level is less than a reference level, for example, the image redraw operation for the entire screen is prohibited. Alternatively, if the display is divided into multiple divisions and is able to display independent images, even though total screen redraw is prohibited, redraw is permitted for at least some divisions of the screen as to which redraw is possible.

It is also acceptable if a display unit that uses a very small amount of power in displaying a message that redraw is forbidden, such as an LED or a small liquid crystal device, is located in a corner of the screen, such that a message that redraw is forbidden is displayed on this unit when the image redraw operation is prohibited. This display also indicates that the power supply has been exhausted. It is also acceptable if the message indicating that screen redraw is forbidden is displayed in a part of the display screen. If only a very small part of the screen is used, this message may be displayed with only the minute amount of remaining power.

DETAILED DESCRIPTION OF THE INVENTION

Embodiments of the information display device pertaining to the present invention will now be explained with reference to the accompanying drawings.

Figure 1:
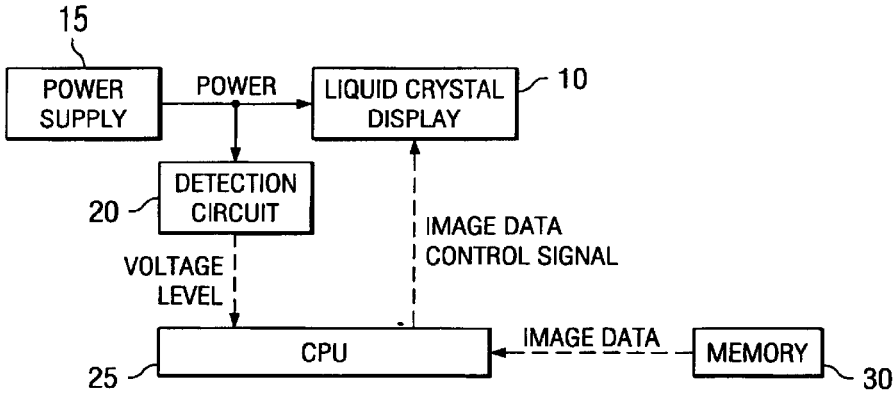
FIG. 1 is a block diagram showing the basic construction of an information display device of a first embodiment of the present invention.

As shown in the block diagram of FIG. 1, the information display device of a first embodiment of the present invention comprises a liquid crystal display 10, a power supply 15 to drive the liquid crystal display 10, a detection circuit 20 to detect the level of voltage supplied from the power supply 15, a CPU 25 that performs overall control, and a memory 30 that stores image data to be displayed.

The screen of the liquid crystal display 10 comprises a liquid crystal material that requires electric power when image draw is performed, and that saves the written image in memory when the supply of power is stopped, i.e., may maintain the display after the power supply terminates.

Types of liquid crystal material having this characteristic include cholesteric liquid crystal and chiral nematic liquid crystal. Cholesteric liquid crystal and chiral nematic liquid crystal have the following advantages: display using selective reflection based on the cholesteric phase of the liquid crystal is possible, it is simple to achieve a construction that does not require back lighting, and a color display is easily attained. Therefore, they are particularly suited for a display device in which the screen is redrawn relatively infrequently and the same display must remain on the screen for a long time, such as a sign, billboard, bulletin board, traffic sign or other display device that displays information to the general public, or for a reading device such as an electronic book or electronic newspaper.

As the liquid crystal-based screen construction and display driving method are already known, their explanation will be omitted here. Where a liquid crystal display is used, the display device may be made thin and lightweight.

Any item of image data stored in the memory 30 is sent to the liquid crystal display 10 together with a control signal based on the instruction from the CPU 25, and is displayed on the screen. The necessary power is supplied by the power supply 15. The power supply 15 comprises a battery, for example, a dry battery or a solar battery, and the level of voltage supplied is detected by the detection circuit 20.

The voltage supplied by the power supply 15 and the decline in the voltage supplied by the power supply 15 will now be explained with reference to FIG. 2. If it is a new power supply, or if it has recently been recharged and has a large amount of charge remaining, sufficient voltage $V_{E1}$, may be supplied, as indicated by line (A). Here, when the display 10 begins to be driven (i.e., the power supply is turned ON), after the initial decline, there is no further decline, and after the driving is stopped (i.e., the power supply is turned OFF), the voltage level immediately recovers to $V_{E1}$.

On the other hand, if the power supply has been used to some extent, and there is little charge remaining, only the low level of voltage $V_{E2}$ can be supplied, as shown by line (B), and when the display 10 is driven, after the initial decline, the voltage continues to fall gradually, such that even if the driving is stopped, the voltage level does not recover to $V_{E2}$.

Figure 2:
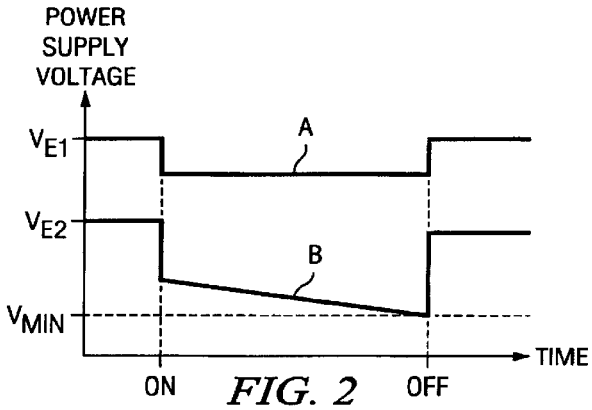
FIG. 2 is a graph showing a voltage fluctuation characteristic of a power supply of the present invention.

The voltage level $V_{MIN}$ in FIG. 2 is the minimum level of voltage necessary to redraw the image on the liquid crystal display 10. If the voltage falls below this level, either the driving of the liquid crystal display 10 itself or the operation of the CPU 25 stops, and as a result, the redrawing of the image on the screen is stopped partway through.

The voltage level $V_{E2}$ can be anticipated beforehand for each system, and if the supplied voltage monitored by the detection circuit 20 equals or exceeds the level $V_{E2}$, the CPU 25 permits image redraw to be performed, while if the supplied voltage is not maintained at $V_{E2}$, image redraw is prohibited. In this description, the reference voltage refers to this voltage level $V_{E2}$. However, the level at which the reference voltage should be set depends on the type of power supply 15.

For example, where the power supply 15 is an accumulating power supply such as a dry battery or a rechargeable battery, when a system operation such as image redraw is performed, the amount of power remaining declines in direct relation to the amount of power consumed, and consequently, the level of voltage provided by the power supply further declines after the system operation is performed. As a result, in this case, the reference voltage must be set taking into consideration the degree of decline in the amount of power remaining. On the other hand, where the power supply 15 is of a type that can generate electricity, such as a solar battery, so long as the amount of light does not decline, there is basically no decline in the power level even after the system operation is performed. Therefore, only the decline in voltage due to a change in the amount of light striking the solar battery and the decline in voltage due to the driving of the liquid crystal display 10 need be taken into account when setting the reference voltage level.

Figure 3:
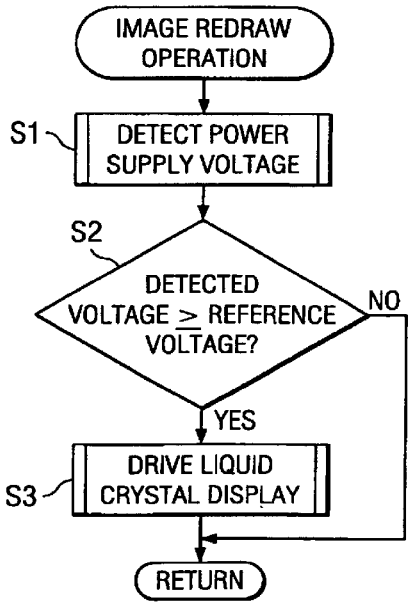
FIG. 3 is a flow chart showing a control sequence for the first embodiment of the present invention.

Next, the control sequence for the image redraw operation in the first embodiment will be explained in summary fashion with reference to FIG. 3.

When the image redraw operation is performed, first, the power supply voltage is detected in step S1, and it is determined in step S2 whether or not the detected voltage level equals or exceeds the reference voltage set beforehand. If the detected voltage level equals or exceeds the reference voltage, the liquid crystal display 10 is driven in step S3 and image redraw is performed. If the detected voltage level is less than the reference voltage, this subroutine comes to an end. In other words, image redraw is prohibited and is not performed.

Figure 4:
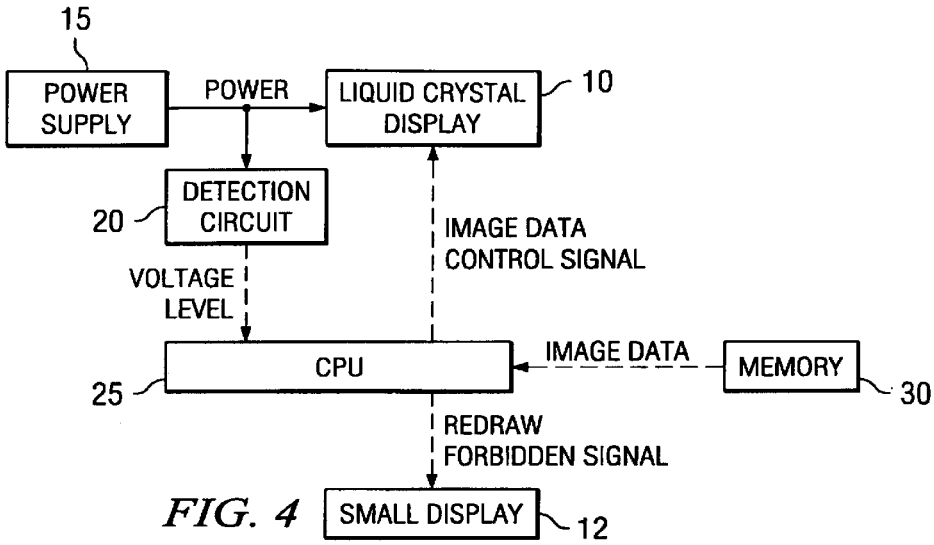
FIG. 4 is a block diagram showing the basic construction of an information display device of a second embodiment of the present invention.
Figure 5:
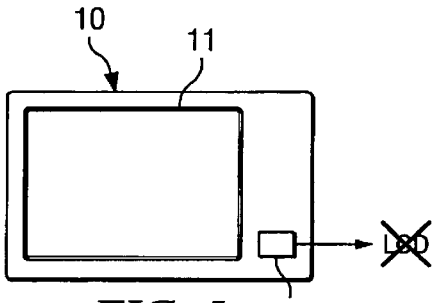
FIG. 5 is a front elevation of a liquid crystal display of the second embodiment of the present invention.

The information display device of a second embodiment of the present invention is as shown in FIGS. 4 and 5. Its construction is essentially identical to that of the first embodiment shown in FIG. 1. It differs in that a small display 12 is located next to the corner of the screen 11 of the liquid crystal display 10.

This small display 12 is a liquid crystal display element that can be driven on a very small amount of power, and where the power supply voltage is less than the reference voltage, it indicates that image redraw is forbidden. The indication that image redraw is forbidden can be carried out in a number of ways. One suitable display is indicated by the enlarged drawing shown at the right side of FIG. 5. A warning provided in a single color may be used as well.

Figure 6:
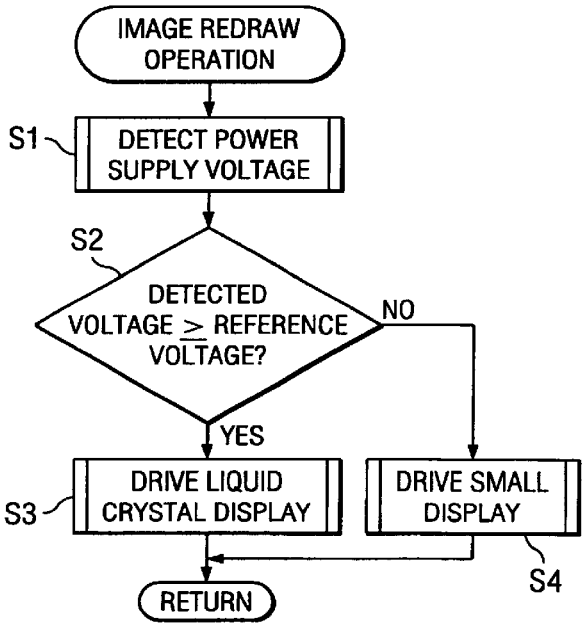
FIG. 6 is a flow chart showing a control sequence for the second embodiment of the present invention.

When the image redraw operation in the second embodiment is performed, as shown in FIG. 6, if it is determined in step S2 that the power supply voltage is less than the reference voltage, the small display 12 is driven in step S4 to indicate that image redraw is forbidden. The other steps in the control sequence shown in FIG. 6 are the same as those shown in FIG. 3.

In the second embodiment, various types of display elements may be used for the small display 12, including not only a liquid crystal display element (in this case, an element having a memory capability is preferred) but also a photo-emitter element such as an LED element, which may be used as a warning lamp.

Figure 7:
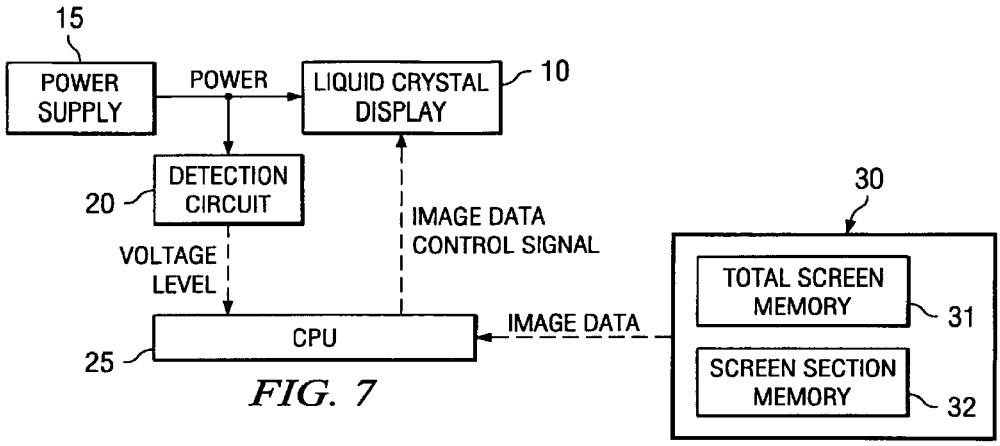
FIG. 7 is a block diagram showing the basic construction of an information display device of a third embodiment of the present invention.
Figure 8:
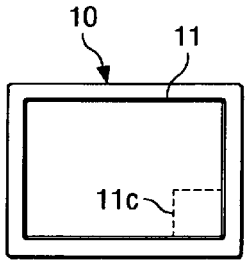
FIG. 8 is a front elevation of a liquid crystal display of the third embodiment of the present invention.

The information display device of a third embodiment of the present invention is as shown in FIGS. 7 and 8. Its construction is essentially identical to that of the first embodiment shown in FIG. 1. It differs in that (i) it has a screen section 11*c* to indicate that image redraw is forbidden which is located at the lower right corner of the screen 11 of the liquid crystal display 10, and (ii) the memory 30 comprises a total screen memory 31 and a screen section memory 32.

Because this screen section 11*c* has a very small area, it may be driven by an extremely small amount of power. If the power supply voltage is less than the reference voltage, it indicates that image redraw is forbidden. This indication may be carried out using various methods, such as the method shown in FIG. 5 incorporating characters and a drawing.

Figure 9:
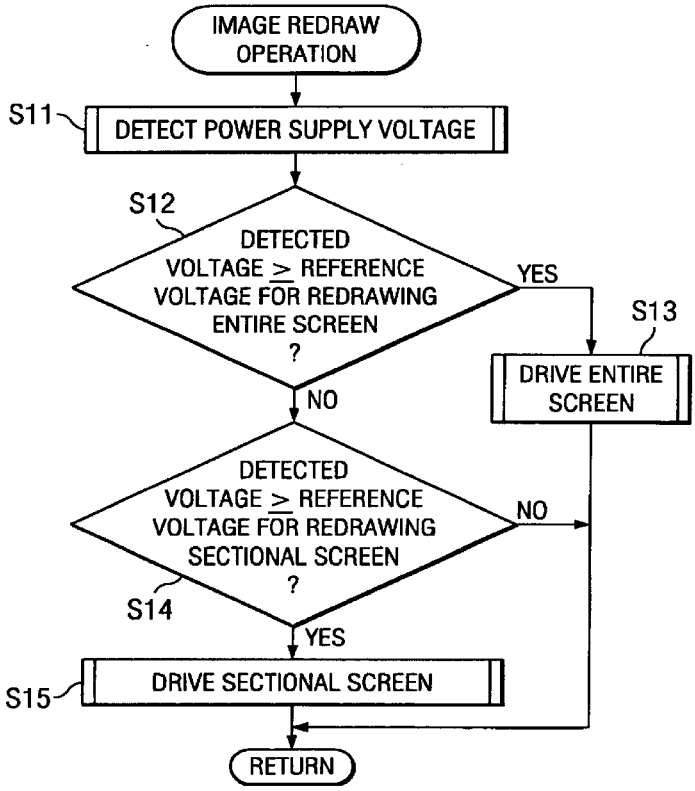
FIG. 9 is a flow chart showing a control sequence for the third embodiment of the present invention.

When the image redraw operation in the third embodiment is performed, as shown in FIG. 9, the power supply voltage is detected in step S11, and it is determined in step S12 whether or not the detected voltage level equals or exceeds the pre-set reference voltage comprising the minimum voltage necessary to redraw the entire screen 11. If the power supply voltage equals or exceeds the reference voltage, the entire screen 11 is driven and the image is redrawn in step S13.

On the other hand, if the reference voltage for the redraw of the entire screen is not met, it is then determined in step S14 whether or not the detected voltage level equals or exceeds the pre-set reference voltage comprising the minimum voltage necessary to redraw the screen section 11*c*. If this reference voltage is met, the screen section 11*c* is driven in step S15 to indicate that image redraw is forbidden. If the detected voltage level is less than the reference voltage necessary to redraw the screen section 11*c*, this subroutine comes to an end.

In this way, if the detected voltage level does not equal or exceed the reference voltage, the image redraw operation for the entire screen 11 of the liquid crystal display is prohibited, and if the detected voltage level is less than the reference voltage necessary to redraw the screen section 11*c*, the image redraw operation for the screen section 11*c* is also prohibited.

In the third embodiment, where the liquid crystal display 10 comprises three stacked-layers of liquid crystal cells that selectively reflect the primary colors of R, G and B, respectively, the screen section 11*c* that indicates that image redraw is forbidden may comprise any one of those layers.

Figure 10:
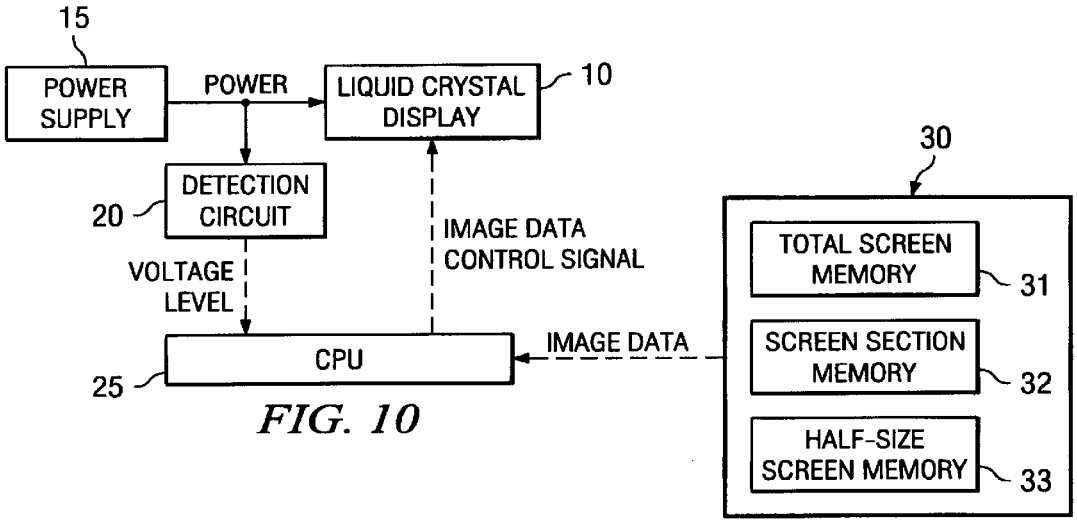
FIG. 10 is a block diagram showing the basic construction of an information display device of a fourth embodiment of the present invention.
Figure 11:
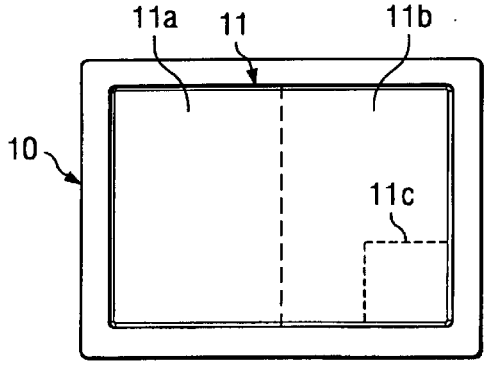
FIG. 11 is a front elevation of a liquid crystal display of the fourth embodiment of the present invention.

The information display device of a fourth embodiment of the present invention is as shown in FIGS. 10 and 11. Its construction is essentially identical to that of the third embodiment shown in FIGS. 7 and 8. It differs in that the screen 11 of the liquid crystal display 10 is divided into two half-size screens 11*a* and 11*b*, each of which can independently display a different image. The screen section 11*c* that indicates that image redraw is forbidden is located at the lower right corner of the half-size screen 11*b*. The memory 30 has, in addition to the entire screen memory 31 and the screen section memory 32, a half-size screen memory 33. The CPU 25 issues instructions regarding which of the half-size screens 11*a* and 11*b* will be used to display the half-size images.

Figure 12:
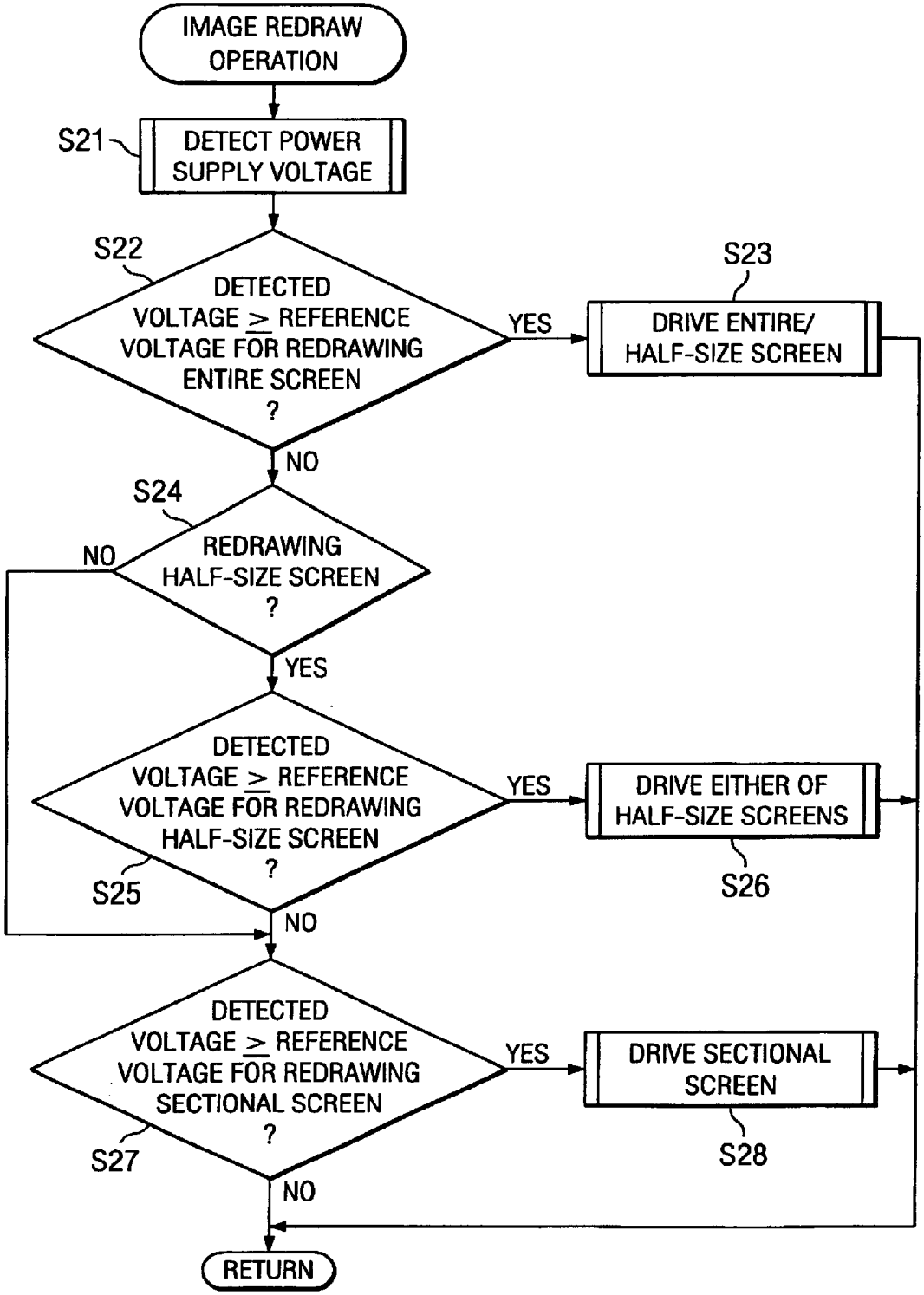
FIG. 12 is a flow chart showing a control sequence for the fourth embodiment of the present invention.

When the image redraw operation in the fourth embodiment is performed, as shown in FIG. 12, first, the power supply voltage is detected in step S21, and it is determined in step S22 whether or not the detected voltage level equals or exceeds the pre-set reference voltage comprising the minimum voltage necessary to redraw the entire screen 11. If the power supply voltage equals or exceeds the reference voltage, the entire screen 11 or the two half-size screens 11*a* and 11*b* are driven and the image is redrawn in step S23.

On the other hand, if the reference voltage for the entire screen is not met, it is then determined in step S24 whether or not redraw of either of the half-size screens 11*a* and 11*b* is instructed. If redraw of one of the half-size screens is instructed, it is determined in step S25 whether or not the detected voltage level equals or exceeds the pre-set reference voltage comprising the minimum voltage necessary to redraw a half-size screen. If the detected voltage level equals or exceeds this reference voltage, either the half-size screen 11*a* or the half-size screen 11*b* is driven and its image is redrawn in step S26.

If the detected voltage level fails to reach the reference voltage for a half-size screen, it is determined in step S27 whether or not the detected voltage level equals or exceeds the pre-set reference voltage comprising the minimum voltage necessary to redraw the screen section 11*c*. If this reference voltage is met, the screen section 11*c* is driven in step S28 to indicate that image redraw is forbidden. If the detected voltage level is less than the reference voltage necessary to redraw the screen section 11*c*, this subroutine comes to an end.

In this way, if the detected voltage level does not equal or exceed the reference voltage for the redraw of the entire screen, the image redraw operation for the entire screen 11 of the liquid crystal display 10 is prohibited. If the detected voltage level is less than the reference voltage necessary for the redraw of a half-size screen, the image redraw operation for the half-size screens 11*a* or 11*b* is prohibited. If the detected voltage level is less than the reference voltage necessary to redraw the screen section 11*c*, the image redraw operation for the screen section 11*c* is prohibited.

Incidentally, where this information display device is used as a bulletin board or billboard, the intended viewers of the liquid crystal display 10 are ordinary persons, not the operators of the system, so the "redraw forbidden" indication that is given in accordance with the state of the power supply is not necessary, and would rather tend to be an unattractive eyesore. For this reason, the construction of the first embodiment in which the "redraw forbidden" indication is not given and the previous image is left on the display is the simplest construction.

If the liquid crystal display 10 is located at a distance from a host device, where it is determined that image redraw is forbidden, that fact may be communicated to the host device by means of a telephone line or other means of communication. Alternatively, it is acceptable if that fact is stored in the CPU 25 and made accessible to the operator.

Although the present invention has been described with reference to a presently preferred embodiment, it will be appreciated by those skilled in the art that various modifications, alternatives, variations, etc. may be made without departing from the spirit and scope of the invention as defined in the appended claims. In particular, the construction of the liquid crystal display and of the overall display system may be freely determined. Further, the entire disclosure of Japanese Patent Application No. 11-244548, filed on Aug. 31, 1999, including the specification, claims, drawings, and abstract, are hereby incorporated by reference in its entirety.

What is claimed is:

1. A display device, comprising:

a display element which maintains a displayed image without a supply of electrical power;

changing means for changing the displayed image using electrical power;

a power supply to supply electrical power to the changing means;

detecting means for detecting a level of voltage supplied by the power supply; and control means for controlling whether the displayed image is changed by the changing means based upon a level of voltage detected by the detecting means.

2. A display device, comprising:

a first display element which requires electrical power to produce an image thereon, wherein the image thus produced is stored in memory after a supply of electrical power terminates;

a power supply to supply electrical power to drive the first display element;

detecting means for detecting a level of voltage supplied by the power supply; and control means for controlling whether the image is redrawn in at least a part of the first display element, based upon the level of voltage detected by the detecting means.

3. A display device, according to claim 2, wherein the first display element is a liquid crystal display element having a memory capability.

4. A display device, according to claim 2, wherein the first display element comprises one of a cholesteric liquid crystal material and a chiral nematic liquid crystal material.

5. A display device, according to claim 2, wherein the control means prevents the image from being redrawn if the level of voltage detected by the detecting means is less than a reference voltage level.

6. A display device, according to claim 2, further comprising a second display element, wherein the control means prevents the image from being redrawn if the level of voltage detected by the detecting means is less than a reference voltage level and the control means controls the second display element to indicate that the image cannot be redrawn.

7. A display device, according to claim 2, wherein the first display element has an indicating portion, wherein the control means prevents the image from being redrawn if the level of voltage detected by the detecting means is less than a reference voltage level and the control means controls the indicating portion to indicate that the image cannot be redrawn.

8. A display device, according to claim 2, wherein the first display element can be divided into a plurality of areas to display a plurality of images, wherein the control means determines which, if any, of the plurality of images can be redrawn based upon the level of voltage detected by the detecting means.

9. A display device, according to claim 8, wherein the first display element has an indicating portion, and wherein the control means controls the indicating portion to indicate that the image cannot be redrawn if the level of voltage detected by the detecting means is less than a reference voltage level.

10. A display device, comprising:

a first display element which requires electrical power to produce an image thereon, wherein the image thus produced is maintained after a supply of electrical power terminates;

a power supply to supply electrical power to drive the first display element;

a detector for detecting a level of voltage supplied by the power supply; and a controller for controlling whether the image is updated in at least a part of the first display element, based upon the level of voltage detected by the detector.

11. A display device, according to claim 10, wherein the first display element comprises a liquid crystal display element having a memory capability.

12. A display device, according to claim 10, wherein the first display element comprises one of a cholesteric liquid crystal material and a chiral nematic liquid crystal material.

13. A display device, according to claim 10, wherein the controller prevents the image from being updated if the level of voltage detected by the detector is less than a reference voltage level.

14. A display device, according to claim 10, further comprising a second display element, wherein the controller prevents the image being updataed if the level of voltage detected by the detector is less than a reference voltage level and the controller controls the second display element to indicate that the image cannot be updated.

15. A display device, according to claim 14, wherein the second display element is able to operate when the levl of voltage detected by the detector is less than the reference voltage level.

16. A display device, according to claim 10, wherein the first display element has an indicating portion, wherein the controller prevents the image from bein updated if the level of voltage detected by the detector is less than a reference voltage level and the controller controls the indicating portion to indicate that the image cannot be updated.

17. A display device, according to claim 10, wherein the first display element can be divided into a plurality of areas to display a plurality of images, wherein the controller determines which, if any, of the plurality of images can be updated based upon the level of voltage detected by the detector.

18. A display device, according to claim 17, wherein the first display element has an indicating portion, and wherein the controller controls the indicating portion to indicate that the image cannot be updated if the level of voltage detected by the detector is less than a reference voltage level.

* * * * *

UNITED STATES PATENT AND TRADEMARK OFFICE

CERTIFICATE OF CORRECTION

PATENT NO. : 7,088,355 B1
APPLICATION NO. : 09/645375
DATED : August 8, 2006
INVENTOR(S) : Keizou Ochi It is certified that error appears in the above-identified patent and that said Letters Patent is hereby corrected as shown below:

Column 8
Line 21, delete "image being updataed" and insert -- image from being updated --.
Line 31, delete "bein updated" and insert -- being updated --.

Signed and Sealed this

Twenty-first Day of November, 2006

JON W. DUDAS
*Director of the United States Patent and Trademark Office*